US010263366B2

(12) United States Patent
Yanagisawa

(10) Patent No.: US 10,263,366 B2
(45) Date of Patent: Apr. 16, 2019

(54) LEVER FITTING-TYPE CONNECTOR

(71) Applicant: YAZAKI CORPORATION, Tokyo (JP)

(72) Inventor: Osamu Yanagisawa, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/981,718

(22) Filed: May 16, 2018

(65) Prior Publication Data

US 2018/0337493 A1 Nov. 22, 2018

(30) Foreign Application Priority Data

May 17, 2017 (JP) ..... 2017-097907

(51) Int. Cl.
*H01R 13/629* (2006.01)
*H01H 27/00* (2006.01)
*H01R 13/703* (2006.01)

(52) U.S. Cl.
CPC ..... *H01R 13/62938* (2013.01); *H01H 27/00* (2013.01); *H01R 13/703* (2013.01); *H01R 2201/26* (2013.01)

(58) Field of Classification Search
CPC ..... H01R 13/62938
See application file for complete search history.

(56) References Cited

U.S. PATENT DOCUMENTS 8,840,409 B2 * 9/2014 Ikeda ..... H01R 13/62938 439/157
8,915,749 B2 * 12/2014 Ikeda ..... H01R 13/62938 439/157
8,986,024 B2 * 3/2015 Ikeda ..... H01R 13/62938 439/157
2008/0102668 A1 5/2008 Ikeya et al.
2013/0126205 A1 5/2013 Henmi

FOREIGN PATENT DOCUMENTS

JP 2016-6754 A 1/2016

OTHER PUBLICATIONS

The extended European search report for the related European Patent Application No. 18172781.9 dated Oct. 9, 2018.
European Office Action for the related European Patent Application No. 18172781.9 dated Feb. 22, 2019.

* cited by examiner

*Primary Examiner* — Tho D Ta
(74) *Attorney, Agent, or Firm* — Kenealy Vaidya LLP

(57) ABSTRACT

A lever fitting-type connector includes a first housing, a lever that has a pair of arm sections each having a cam groove, and a second housing having a pair of cam pins. Each of the cam grooves includes an inlet section, a curved section, and a guide rail section provided on an inner peripheral face of the cam groove. The inlet section has a running-on preventing portion which is formed so that the cam pin enters the inlet section without allowing the guide rail section to run on the cam pin.

8 Claims, 7 Drawing Sheets

LEVER FITTING-TYPE CONNECTOR

CROSS REFERENCE TO RELATED APPLICATIONS

This application is based on Japanese Patent Application (No. 2017-097907) filed on May 17, 2017, the contents of which are incorporated herein by reference.

BACKGROUND OF THE INVENTION

1. Field of the Invention

The present invention relates to a lever fitting-type connector being characterized in that its housing is made closer to its mating housing and inserted into the mating housing by rotating a lever.

2. Description of the Related Art

As technologies relating to the above-mentioned lever fitting-type connector (also referred to as "lever-type connector"), for example, the technology disclosed in Patent Document 1 is known.

As shown in FIG. 1 of Patent Document 1, a lever-type connector 1 is equipped with a first connector housing 10 accommodating terminals, not shown, a second connector housing 20 to be fitted into this first connector housing 10, and a lever 30 rotatably installed in this second connector housing 20, the second connector housing 20 being made closer to the first connector housing 10 and fitted thereinto by rotating the lever.

The first connector housing 10 is equipped with a peripheral wall into which the second connector housing 20 is fitted and cam pins 11 provided so as to protrude on the outer faces of both sides of this peripheral wall.

The lever 30 is equipped with a pair of arm plate sections between which the second connector housing 20 is sandwiched and a lever operation section 33 for connecting this pair of arm plate sections 31. Each arm plate section 31 is provided with a cam groove 35 with which each of the cam pins 11 provided on the first connector housing 10 is slide-engaged.

The fitting operation between the first connector housing 10 and the second connector housing 20 in the lever-type connector 1 configured as described above will be described below. First, the second connector housing 20 is inserted into the peripheral wall of the first connector housing 10 as shown in FIG. 2 of Patent Document 1. At this time, each of the pair of cam pins 11 of the first connector housing 10 is made to enter the inside of the cam groove 35 provided in each arm plate section 31 (this operation is hereafter referred to as "temporary setting").

After that, the lever 30 is rotated in the fitting direction shown in FIG. 3 of Patent Document 1 from the above-mentioned temporary setting position, whereby the second connector housing 20 is made closer to the first connector housing 10. When the rotation of the lever 30 in the fitting direction is completed as shown in FIGS. 1 to 4 of Patent Document 1, the second connector housing 20 is fitted into the first connector housing 10.

A technology in which a guide rail section is provided on the inner peripheral face of the cam groove of a lever has been used conventionally to improve fitting operability at the time when connector housings are mutually fitted. Although such a guide rail section is not designated by a reference numeral or described particularly in JP-A-2016-6754, a guide rail section is formed into a flange shape on the inner peripheral face of the cam groove so as to be engageable with the cam pin as shown in FIGS. 1 and 2 of JP-A-2016-6754.

However, when the connector housings are mutually set temporally, the guide rail section occasionally runs on the cam pin at the inlet section of the cam groove. In the state in which the guide rail section has run on the cam pin, if an attempt is made to mutually fit the connector housings by rotating the lever, there is a problem that product damage may occur.

SUMMARY OF THE INVENTION

The present invention is made in consideration of the above-mentioned circumstances and is intended to provide a lever fitting-type connector capable of preventing product damage caused by the running of the guide rail section on the cam pin.

A lever fitting-type connector according to an item (1) for solving the above-mentioned problem is a lever fitting-type connector including:

a first housing configured to accommodate a first terminal;

a lever that has a pair of arm sections which sandwiches the first housing therebetween and that is rotatably attached to the first housing, and each of the arm sections having a cam groove; and a second housing configured to accommodate a second terminal, and that has a peripheral wall configured to receive the first housing thereinto and a pair of cam pins provided on outer faces of both sides of the peripheral wall and protruding outwardly to be engaged with the cam grooves respectively, wherein each of the cam grooves includes:

an inlet section which is formed so that the cam pin can enter;

a curved section which is formed so that a distance between the curved section and a rotation center axis of the lever is smaller as the curved section is away from a portion communicating with the inlet section to an innermost section of the cam groove; and a guide rail section provided on an inner peripheral face of the cam groove and formed so that the cam pin can be engaged therewith; and wherein the inlet section has a running-on preventing portion which is formed so that the cam pin enters the inlet section without allowing the guide rail section to run on the cam pin.

With the above item (1), since the inlet section of the cam groove is provided with the running-on preventing portion, the cam pin can be made to enter the inlet section without allowing the guide rail section to run on the cam pin.

For example, there is provided the lever fitting-type connector according to an item (2), wherein the inner peripheral face of each of the cam grooves includes:

an outer edge-side inner peripheral face formed on an outer edge section of the arm section; and a rotation center axis-side inner peripheral face formed closer to the rotation center axis of the lever than the outer edge-side inner peripheral face;

wherein the running-on preventing portion has a running-on preventing space that is formed by a cut-out portion of the guide rail section on the rotation center axis-side inner peripheral face of the inlet section; and wherein the guide rail section is formed on the outer edge-side inner peripheral face of the inlet section and is engageable with the cam pin when the cam pin enters the inlet section.

With the above item (2), since the running-on preventing space is formed by the cut out portion of the guide rail section on the rotation center axis-side inner peripheral face against which the cam pin abuts when the cam pin is made to enter the inlet section, the cam pin can be made to enter the inlet section more securely without allowing the guide rail section to run on the cam pin. Furthermore, since the cam pin is engaged with the guide rail section on the outer edge-side inner peripheral face of the inlet section when the cam pin has entered the inlet section, lever insertion operability can be improved.

For example, there is provided the lever fitting-type connector according to an item (3), wherein a guide wall is provided so as to protrude along a peripheral edge of the cam groove.

With the above item (3), since the guide wall is provided so as to protrude along the peripheral edge of the cam groove, the cam pin can be guided by the guide wall. In particular, when the cam pin has entered the inlet section, since the cam pin makes contact with the guide wall and is guided thereby, the cam pin can be disposed at the position predetermined at the start time of the rotation operation of the lever. Hence, the lever insertion operability can be further improved.

Also, for example, the cam pin entered into the inlet section is movable to the running-on preventing space.

For example, there is provided the lever fitting-type connector according to an item (4), wherein the first terminal accommodated in the first housing and the second terminal accommodated in the second housing are portions of a service plug for performing switching between an energized state and a shutoff state of a power circuit; and wherein the power circuit is switched to the energized state when the first terminal is connected to the second terminal and is switched to the shutoff state when the connection of the first terminal and the second terminal is released.

With the above item (4), since the lever fitting-type connector can be applied to a service plug, the cam pin can be made to enter the inlet section without allowing the guide rail section to run on the cam pin, and lever insertion operability can be improved.

With the lever fitting-type connector according to the present invention, since the cam pin can be made to enter the inlet section without allowing the guide rail section to run on the cam pin, the present invention has an effect capable of preventing product damage caused by the running of the guide rail section on the cam pin.

DETAILED DESCRIPTION OF THE EXEMPLARY EMBODIMENTS

An embodiment of a lever-fitting-type connector according to the present invention will be described below referring to FIG. 1 to FIGS. 5A and 5B.

Figure 1:
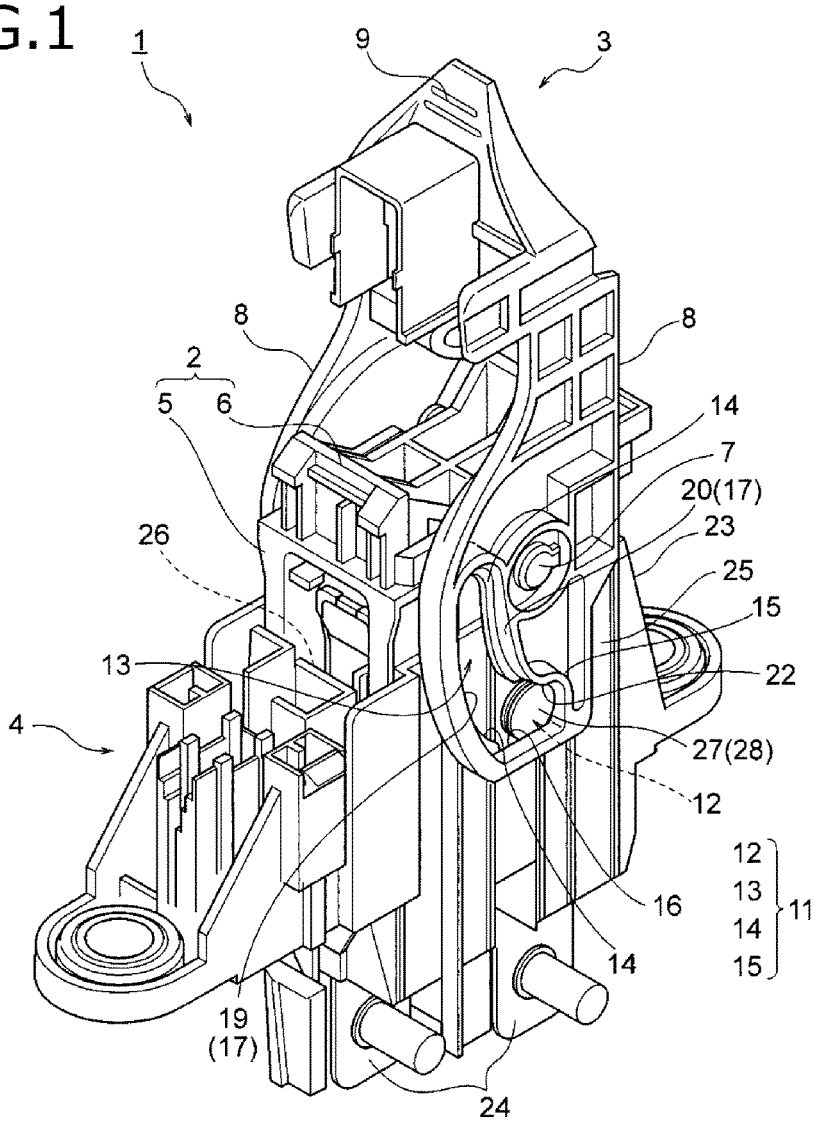
FIG. 1 is a perspective view showing a service plug taken as an example of a lever-fitting-type connector according to an embodiment of the present invention.
Figure 2:
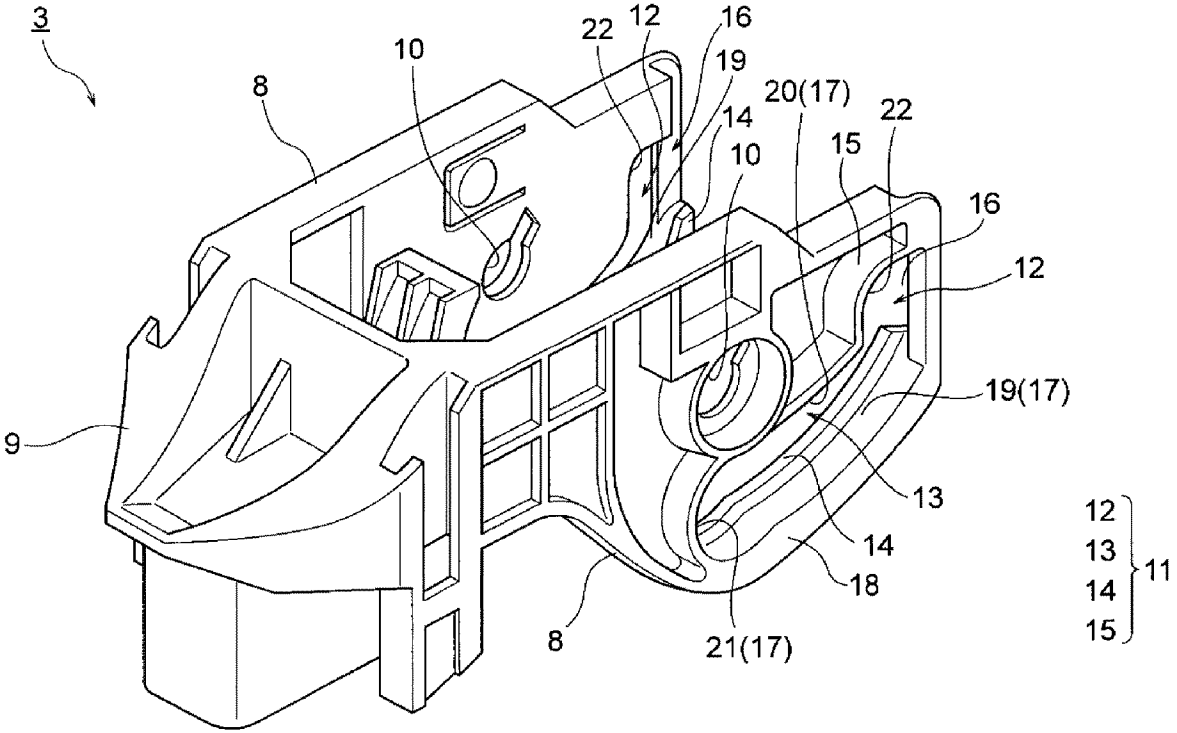
FIG. 2 is a perspective view showing the lever shown in FIG. 1.
Figure 3A:
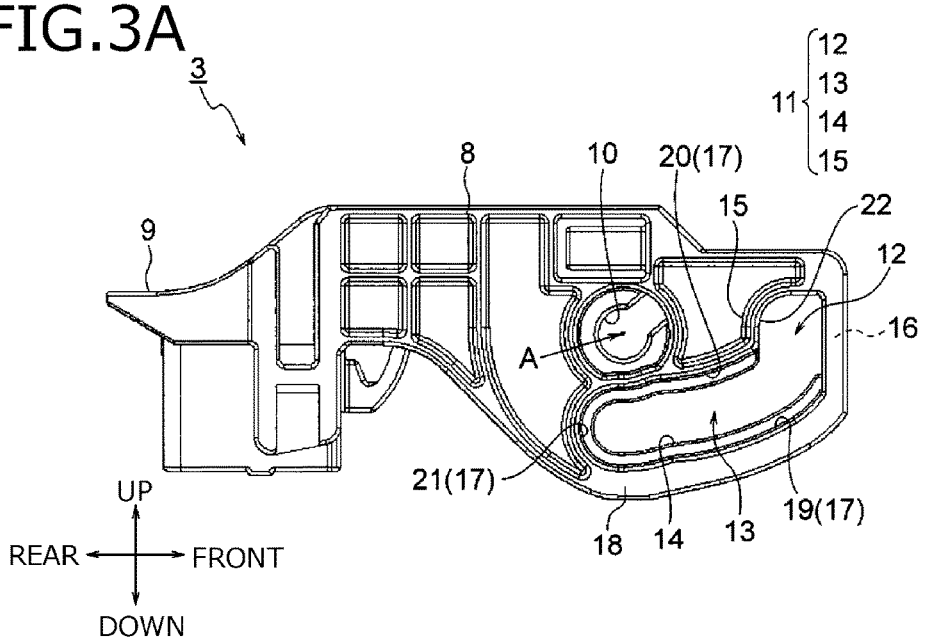
FIG. 3A is a side view showing the lever shown in FIG. 1.
Figure 3B:
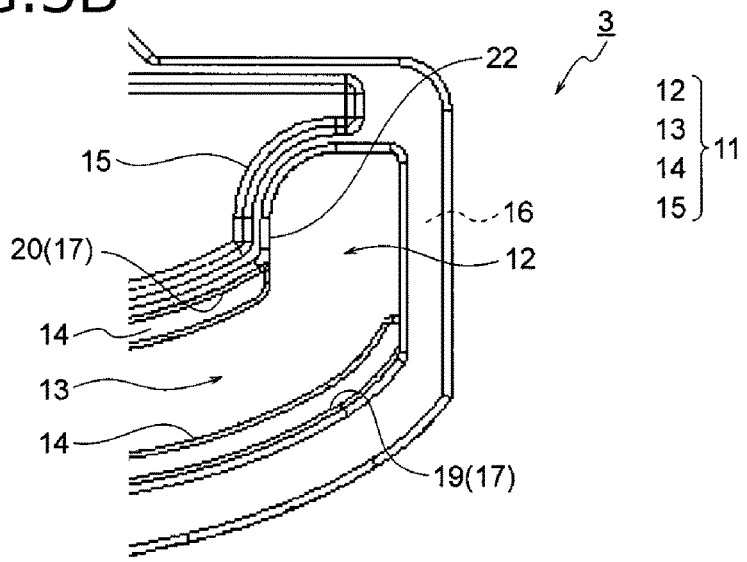
FIG. 3B is an enlarged view showing the vicinity of the inlet section of the cam groove shown in FIG. 3A.
Figure 4:
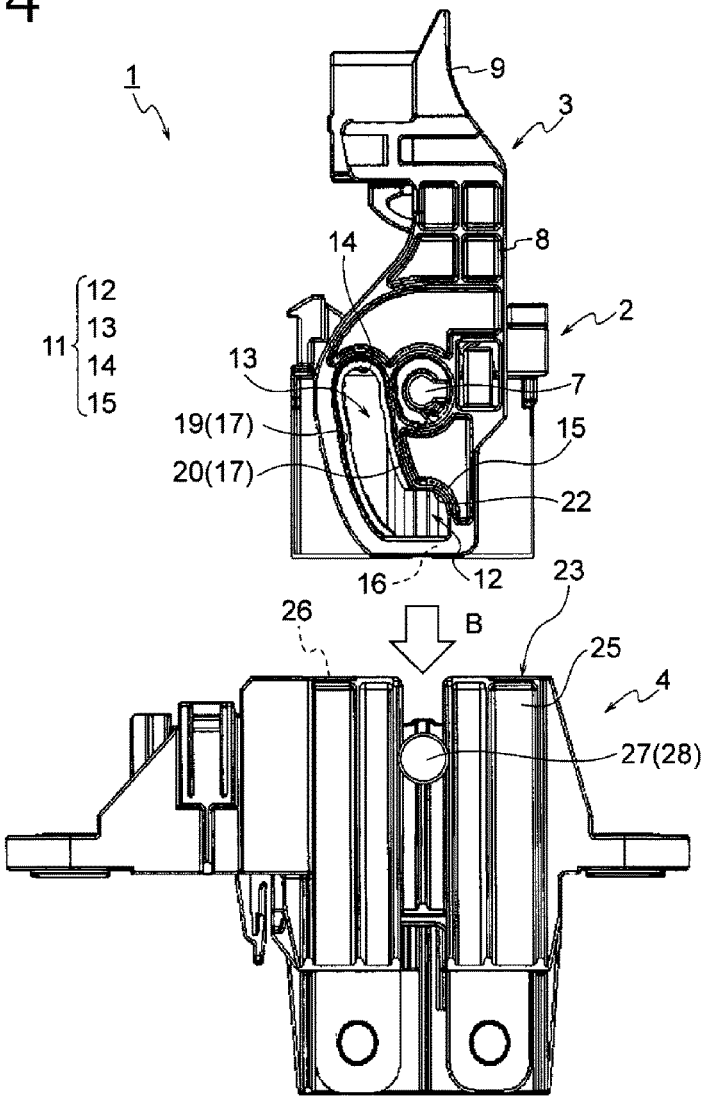
FIG. 4 is a side view showing a state before a housing is inserted into a mating housing.
Figure 5A:
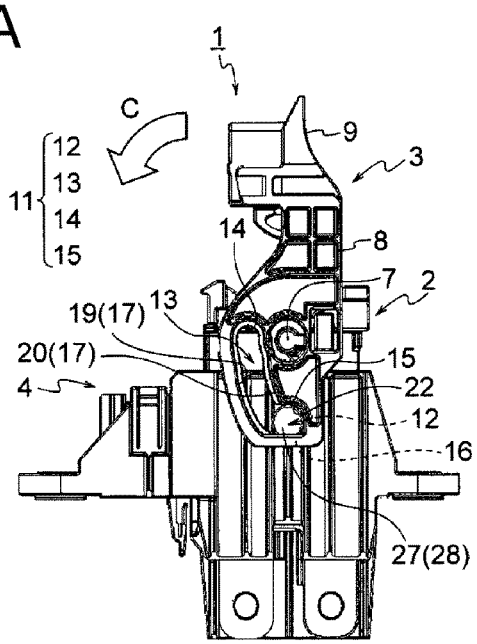
FIG. 5A is a side view showing a state in which the housing has been inserted into the mating housing.
Figure 5B:
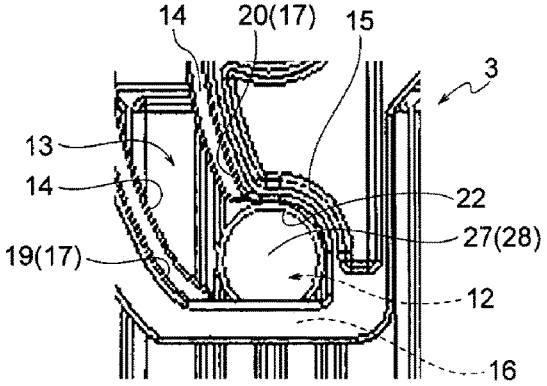
FIG. 5B is an enlarged view showing the vicinity of the inlet section of the cam groove shown in FIG. 5A.

FIG. 1 is a perspective view showing a service plug taken as an example of a lever-fitting-type connector according to an embodiment of the present invention; FIG. 2 is a perspective view showing the lever shown in FIG. 1; FIGS. 3A and 3B are views showing the lever shown in FIG. 1, FIG. 3A being a side view showing the lever, and FIG. 3B being an enlarged view showing the vicinity of the inlet section of the cam groove shown in FIG. 3A; FIG. 4 is a view illustrating operation for fitting a housing into a mating housing and showing a state before the housing is fitted into the mating housing; and FIGS. 5A and 5B are views following FIG. 4, FIG. 5A being a side view showing a state in which the housing has been inserted into the mating housing, and FIG. 5B being an enlarged view showing the vicinity of the inlet section of the cam groove shown in FIG. 5A.

The arrows in the figures respectively indicate up, down, front and rear directions (it is assumed that the respective directions of the arrows are examples).

As shown in FIG. 1, in this embodiment, a service plug 1 functioning as a power circuit breaker is taken as an example of a lever fitting-type connector and described. The service plug 1 is installed, for example, in vehicles (for example, a hybrid vehicle and an electric vehicle) and is used to shut off the power circuit for making a connection between the motor for driving the vehicle and the battery for supplying electric power to the motor. The service plug 1 in this embodiment is installed in a battery case (this is just taken as an example; the service plug, however, is not limited to be installed in the battery case, provided that the service plug shuts off the power circuit; furthermore, the service plug is not limited to be installed in a vehicle).

As shown in FIG. 1, the service plug 1 is equipped with a housing 2, a lever 3 and a mating housing 4. The configurations of the respective components of the service plug 1 will be described below.

First, the housing 2 will be described.

As shown in FIG. 1, the housing 2 is equipped with a housing body 5 and a cover 6. The housing body 5 is molded from a synthetic resin material having insulation properties and is formed so as to be capable of being fitted into the mating housing 4 as shown in FIG. 1. Rotation shafts 7 are respectively provided so as to protrude on the outer faces on both sides of the housing body 5. Male terminals, not shown, are accommodated inside the housing body 5. The male terminals correspond to "first terminal" in claims.

The cover 6 is molded from of a synthetic resin material having insulation properties and is formed so as to be capable of being installed on the upper face of the housing body 5 as shown in FIG. 1.

Next, the lever 3 will be described.

As shown in FIGS. 1 to 3, the lever 3 is molded from of a synthetic resin material having insulation properties and is equipped with a pair of arm sections 8 and an operation section 9. Each of the pair of arm sections 8 is provided with a rotation shaft supporting section 10 and a cam groove 11.

The rotation shaft supporting section 10 is formed so that the rotation shaft 7 of the housing body 5 can be installed so as to be rotatable. Since the rotation shaft 7 of the housing body 5 is installed in the rotation shaft supporting section 10 so as to be rotatable, the lever 3 is installed on the housing 2 so as to be rotatable.

The cam groove 11 is a characteristic portion in the present invention. As shown in FIG. 2 and FIGS. 3A and 3B, the cam groove 11 is equipped with an inlet section 12, a curved section 13 and a guide rail section 14 provided on the inner peripheral face 17 of the cam groove 11. Furthermore, the cam groove 11 is equipped with a guide wall 15 provided along the peripheral edge thereof.

The inner peripheral face 17 of the cam groove 11 is equipped with an outer edge-side inner peripheral face 19, a rotation center axis-side inner peripheral face 20 and an innermost inner peripheral face 21. The outer edge-side inner peripheral face 19 is formed on the side of the outer edge section 18 of the arm section 8. The outer edge-side inner peripheral face 19 corresponds to the inner peripheral face 17 on the lower side in FIG. 3A. The rotation center axis-side inner peripheral face 20 is formed closer to the side of the rotation center axis A of the lever 3 than the outer edge-side inner peripheral face 19. The rotation center axis-side inner peripheral face 20 corresponds to the inner peripheral face 17 on the upper side in FIG. 3A. The innermost inner peripheral face 21 is formed so as to connect the outer edge-side inner peripheral face 19 to the rotation center axis-side inner peripheral face 20 at the innermost section of the cam groove 11 (the curved section 13).

As shown in FIGS. 2 and 3A, the inlet section 12 is provided on one end side of the arm section 8 in the longitudinal direction thereof (on the front end side in the front-rear direction in FIG. 2 and FIG. 3A). The inlet section 12 is formed such that, when the cam pin 27, described later, of the mating housing 4 is made to enter the inside of the cam groove 11, the inlet section 12 is formed as the portion where the cam pin 27 first enters. The inlet section 12 is equipped with an entry opening 16 and a running-on preventing space 22 (running-on preventing portion).

The entry opening 16 is formed at the one end of the arm section 8 in the longitudinal direction thereof so that the inlet section 12 communicates with the outside. The entry opening 16 is formed so as to allow the entry of the cam pin 27.

The running-on preventing space 22 corresponds to "running-on preventing portion" in claims. The running-on preventing space 22 is formed by cutting out the guide rail section 14 on the rotation center axis-side inner peripheral face 20 of the inlet section 12. The running-on preventing space 22 is formed so that the cam pin 27 can be made to enter the inlet section 12 without allowing the guide rail section 14 to run on the cam pin 27. Since the running-on preventing space 22 is formed on the rotation center axis-side inner peripheral face 20 of the inlet section 12, the guide rail section 14 is prevented from running on the cam pin 27 when the cam pin 27 is made to enter the inlet section 12.

The curved section 13 is formed so that the distance of the curved section 13 from the rotation center axis A of the lever 3 is smaller as the curved section 13 is away from the portion communicating with the inlet section 12 to the innermost section of the cam groove 11 as shown in FIG. 3A.

The guide rail section 14 is continuously provided along the outer edge-side inner peripheral face 19 of the inlet section 12, the outer edge-side inner peripheral face 19 of the curved section 13, the innermost inner peripheral face 21 of the curved section 13 and the rotation center axis-side inner peripheral face 20 of the curved section 13 as shown in FIG. 3A. The guide rail section 14 is formed so that the cam pin 27 can be engaged therewith.

The guide rail section 14 formed on the outer edge-side inner peripheral face 19 of the inlet section 12 is formed so as to be engageable with the cam pin 27 when the cam pin 27 is made to enter the inlet section 12.

The guide wall 15 is provided so as to protrude along the peripheral edge of the cam groove 11 as shown in FIG. 2 and FIGS. 3A and 3B. The guide wall 15 is formed so that, when the cam pin 27 is made to enter the cam groove 11, the cam pin 27 makes contact with the guide wall 15 and so that the guide wall 15 guides the movement of the cam pin 27 inside the cam groove 11.

Next, the mating housing 4 will be described.

As shown in FIG. 1, the mating housing 4 is the housing on the side of the power circuit and is equipped with a mating housing body 23 and female terminals 24. The mating housing body 23 is molded from a synthetic resin material having insulation properties and is equipped with a peripheral wall 25 and a housing fitting chamber 26 as shown in FIG. 1.

The peripheral wall 25 is formed so that the housing 2 can be fitted therein. The pair of cam pins 27 is provided so as to protrude on both side faces of the peripheral wall 25. The cam pin 27 is formed so as to be engageable with the cam groove 11. The cam pin 27 is equipped with a shaft section, not shown, continuing to the peripheral wall 25 and a flange section 28 that is formed so as to continue to this shaft section.

The housing fitting chamber 26 is a space enclosed with the peripheral wall 25 and the upper face thereof is open. The female terminals 24 electrically connected to the power circuit are accommodated inside the housing fitting chamber 26. The female terminals correspond to "a second terminal" in claims.

Next, operation for fitting the housing 2 into the mating housing 4 will be described.

First, as shown in FIG. 4, in the state in which the lever 3 installed in the housing 2 is stood upright, the housing 2 is moved from the side of the housing body 5 in the direction indicated by the arrow B shown in FIG. 4.

As the housing 2 is continuously moved in the direction indicated by the arrow B shown in FIG. 4, the side of the housing body 5 of the housing 2 is inserted into the housing fitting chamber 26 of the mating housing 4. At this time, as shown in FIG. 5B, each of the cam pins 27 of the mating housing 4 passes through the entry opening 16 of the cam groove 11 and enters the inlet section 12 (this operation is hereafter referred to as "temporary setting").

In the state of the temporary setting, since the flange section 28 makes contact with the guide wall 15, the cam pin 27 having entered the inlet section 12 is disposed at the position predetermined at the start time of the rotation operation of the lever 3. Furthermore, the cam pin 27 having entered the inlet section 12 is engaged with the guide rail section 14 of the outer edge-side inner peripheral face 19 of the inlet section 12.

In this state, as shown in FIG. 5B, since the inlet section 12 is provided with the running-on preventing space 22, the running-on preventing space 22 serves as an escape space for the cam pin 27. Since the inlet section 12 is provided with the running-on preventing space 22 as described above, the guide rail section 14 is prevented from running on the cam pin 27 having entered the inlet section 12 even in the case that prying has occurred.

Next, the running of the guide rail section 14 on the cam pin will be described referring to FIG. 6 and FIGS. 7A and 7B.

Figure 6:
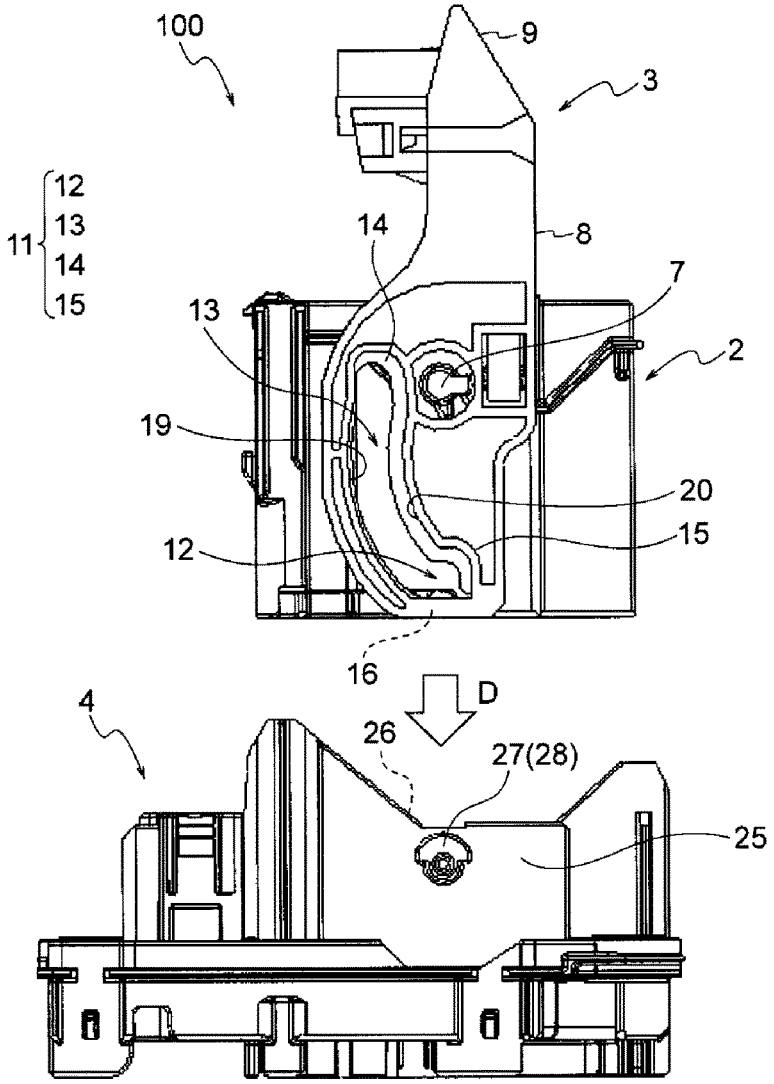
FIG. 6 is an exploded side view showing a service plug taken as an example of a lever fitting-type connector according to a comparative example.

FIG. 6 is an exploded side view showing a service plug taken as an example of a lever fitting-type connector according to a comparative example. FIGS. 7A and 7B are views following FIG. 6; FIG. 7A is a view showing a state in which the guide rail section has run on the cam pin at the time when the housing shown in FIG. 6 is inserted into the mating housing, and FIG. 7B is an enlarged view showing the vicinity of the inlet section of the cam groove shown in FIG. 7A.

Figure 7A:
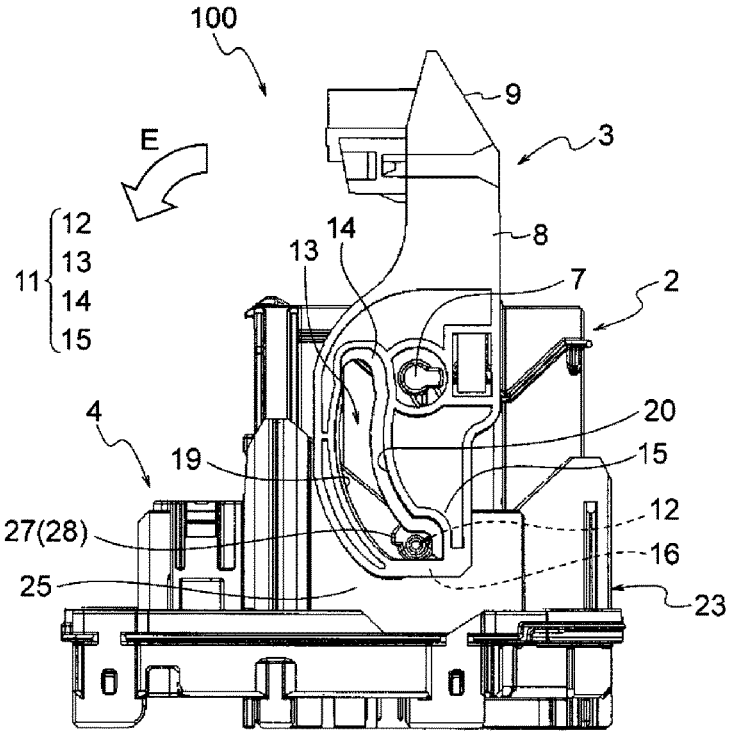
FIG. 7A is a view showing a state in which a guide rail section runs on a cam pin at the time when the housing shown in FIG. 6 is inserted into the mating housing.
Figure 7B:
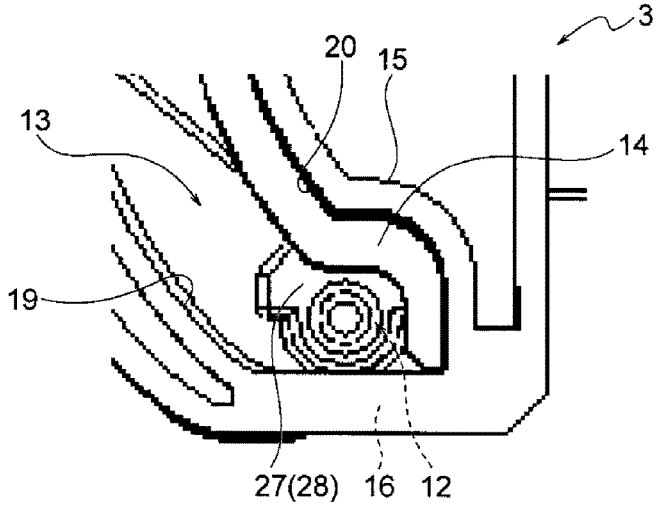
FIG. 7B is an enlarged view showing the vicinity of the inlet section of the cam groove in this state.

The service plug 100 shown in FIG. 6 and FIGS. 7A and 7B is taken as an example of the lever fitting-type connector according to the comparative example. The service plug 100 basically has the same configuration and structure as those of the service plug 1 according to this embodiment, except that the inlet section 12 is not equipped with the running-on preventing space 22 according to this embodiment. Hence, the same components as those according to this embodiment are designated by the same reference numerals and their detailed descriptions are omitted.

First, as shown in FIG. 6, the housing 2 is inserted (temporarily set) into the mating housing 4 in the direction indicated by the arrow D shown in FIG. 6. Since the temporarily setting operation is the same as that according to this embodiment, the detailed descriptions thereof are omitted.

In this state, since the inlet section 12 is provided with the guide rail section 14 on the rotation center axis-side inner peripheral face 20 as shown in FIGS. 7A and 7B, in the case that prying has occurred at the time of the temporarily setting, the guide rail section 14 runs on the cam pin 27 having entered the inlet section 12. In the state in which the guide rail section has run on the cam pin as described above, if the lever 3 is rotated in the direction indicated by the arrow E shown in FIG. 7A, product damage may occur.

Returning to FIGS. 5A and 5B, the description of the operation for fitting the housing 2 into the mating housing 4 according to this embodiment is given continuously.

In FIG. 5A, the housing 2 is made closer to the mating housing 4 by rotating the lever 3 in the direction indicated by the arrow C shown in FIG. 5A. After that, when the above-mentioned rotation of the lever 3 is completed, the housing 2 is fitted into the mating housing 4, whereby the male terminals, not shown, accommodated in the housing 2 are electrically connected to the female terminals 24 accommodated in the mating housing 4. Hence, the power circuit can be set to an energized state. Consequently, the operation for fitting the housing 2 into the mating housing 4 is completed.

The operation for releasing the fitting of the housing 2 and the mating housing 4 is performed by returning the lever 3 to such an upright standing state as shown in FIG. 5A. By this operation, the electrical connection between the male terminals of the housing 2 and the female terminals of the mating housing 4 is released and the power circuit can be set to a shutoff state.

With this embodiment, the cam pin 27 can be made to enter the inlet section 12 without allowing the guide rail section 14 to run on the cam pin 27 as described above referring to FIG. 1 to FIGS. 5A and 5B, whereby this embodiment has an effect capable of preventing product damage caused by the running of the guide rail section 14 on the cam pin 27.

In addition, the present invention can be modified variously within the range not deviated from the gist of the invention as a matter of course.

What is claimed is:

1. A lever fitting-type connector comprising:

a first housing configured to accommodate a first terminal;

a lever that has a pair of arm sections which sandwiches the first housing therebetween and that is rotatably attached to the first housing, and each of the arm sections having a cam groove; and a second housing configured to accommodate a second terminal, and that has a peripheral wall configured to receive the first housing thereinto and a pair of cam pins provided on outer faces of both sides of the peripheral wall and protruding outwardly to be engaged with the cam grooves respectively, wherein each of the cam grooves includes:

an inlet section which is formed so that the cam pin can enter;

a curved section which is formed so that a distance between the curved section and a rotation center axis of the lever is smaller as the curved section is away from a portion communicating with the inlet section to an innermost section of the cam groove; and a guide rail section provided on an inner peripheral face of the cam groove and formed so that the cam pin can be engaged therewith; and wherein the inlet section has a running-on preventing portion which is formed separate from the guide rail section so that the guide rail section terminates ahead of the running-on preventing portion and the cam pin thereby enters the inlet section without allowing the guide rail section to run on the cam pin.

2. The lever fitting-type connector according to claim 1, wherein the inner peripheral face of each of the cam grooves includes:

an outer edge-side inner peripheral face formed on an outer edge section of the arm section; and a rotation center axis-side inner peripheral face formed closer to the rotation center axis of the lever than the outer edge-side inner peripheral face;

wherein the running-on preventing portion has a running-on preventing space that is formed by a cut-out portion of the guide rail section on the rotation center axis-side inner peripheral face of the inlet section; and wherein the guide rail section is formed on the outer edge-side inner peripheral face of the inlet section and is engageable with the cam pin when the cam pin enters the inlet section.

3. The lever fitting-type connector according to claim 1, wherein a guide wall is provided so as to protrude along a peripheral edge of the cam groove.

4. The lever fitting-type connector according to claim 1, wherein the cam pin entered into the inlet section is movable to the running-on preventing space.

5. The lever fitting-type connector according to claim 1, wherein the first terminal accommodated in the first housing and the second terminal accommodated in the second housing are portions of a service plug for performing switching between an energized state and a shutoff state of a power circuit; and wherein the power circuit is switched to the energized state when the first terminal is connected to the second terminal and is switched to the shutoff state when the connection of the first terminal and the second terminal is released.

6. The lever fitting-type connector according to claim 1, wherein the cam pin and the guide rail section are stepped so as to fit together when engaged.

7. The lever fitting-type connector according to claim 1, wherein the guide rail section is provided with a protruding rail part extending thereon, and the cam pin includes a peripheral guide slot configured for engagement with the protruding rail part of the guide rail section.

8. The lever fitting-type connector according to claim 7, wherein the protruding rail part of the guide rail section terminates ahead of the running-on preventing portion so that the cam pin enters the inlet section at the running-on preventing portion disengaged from the protruding rail part.

* * * * *